US005287079A

United States Patent [19]

Bernardi et al.

[11] Patent Number: 5,287,079

[45] Date of Patent: Feb. 15, 1994

[54] SUB-MINIATURE PLASTIC FUSE

[75] Inventors: Angelina M. Bernardi, St. Louis; James Cook, Glencoe; Leon Gurevich, St. Louis, all of Mo.; Ronald Peterson, Frome, England

[73] Assignee: Cooper Industries, Inc., Houston, Tex.

[21] Appl. No.: 973,790

[22] Filed: Nov. 9, 1992

[51] Int. Cl.[5] ..... H01H 85/02; H01H 85/143

[52] U.S. Cl. ..... 337/203; 337/249; 337/250

[58] Field of Search ..... 337/203, 249, 250, 186

[56] References Cited

U.S. PATENT DOCUMENTS 4,483,064 11/1984 Bernstein ..... 337/186
4,628,293 12/1986 Marx ..... 337/216
5,179,436 1/1993 Asdollahi et al. ..... 337/203

*Primary Examiner*—Harold Broome
*Attorney, Agent, or Firm*—Laff, Whitesel, Conte & Saret

[57] ABSTRACT

There is provided a fast acting subminiature cylindrical fuse having a cylindrical cover substantially locked onto a cylindrical base. The locking mechanism for the cover comprises a plurality of grooves and a plurality of corresponding projections on the internal surface of the cover and the external surface of the fuse base. The lock projections have a relatively straight diverging upper surface and a rounded bottom locking surface. The fuse base has a spacing ridge on the bottom thereof that spaces the fuse bottom surface above a circuit board surface. The fuse also has a plurality of pressure relieving passageways extending from inside the fuse to the outside of the fuse.

15 Claims, 2 Drawing Sheets

SUB-MINIATURE PLASTIC FUSE

This invention relates to a subminiature fuse. More particularly the invention relates to a cylindrical subminiature plastic fuse wherein sufficient means are provided to maintain a cap on the fuse body when the fuse blows and to provide a plurality of pressure relieving passageways.

BACKGROUND OF THE INVENTION

Subminiature fuses are generally vacuum sealed, are air tight, or have no separate pressure relieving passageways, as shown by U.S. Pat. Nos. 4,899,123, 4,417,226, 4,349,805; 3,227,841 and 3,110,787. Also, the prior art generally requires a refractory fuse housing U.S. Pat. No. 3,227,841; a metal liner, U.S. Pat. No. 4,899,123 or an arc quenching filler U.S. Pat. No. 3,110,787.

The prior art subminiature fuses are generally prone to being damaged easily if there is a high pressure build up in the fuse caused by the fuse blowing.

If the cover of the fuse fractures, or releases from the fuse, it could cause damages to surrounding parts on the circuit board. Some of the prior art attempts to provide the fuse with a plurality of locking devices. U.S. Pat. No. 4,628,293 shows using three annular ribs on the base. The annular ribs are rounded.

Therefore, it is an object of the present invention to provide a subminiature fuse that will substantially alleviate some of the above problems encountered by the prior art.

An object of the present invention is to provide a subminiature fuse having a plurality of vent passageways extending from inside the fuse to the outside of the fuse.

Another object of the present invention is to provide a subminiature fuse having a plurality of locking projections on the fuse base wherein said locking projections have an upper frustro-conical surface and a lower locking rounded surface that cooperates with corresponding grooves in the fuse cover, and a plurality of pressure relieving passageways extending from the upper surface of said fuse base to the outside of said fuse.

Other objects will become apparent to those skilled in the art when the specification is read in conjunction with the attached drawings.

SUMMARY OF THE INVENTION

This invention provides a fast acting subminiature cylindrical fuse which has a cylindrical cover substantially locked onto a cylindrical base. The locking mechanism for the cover comprises a plurality of grooves and a plurality of corresponding projections on the internal surface of the cover and the external surface of the fuse base. Preferably, there are three annular grooves formed in the inner cover wall with the grooves having a single radius. The base has extending around its cylindrical side wall three corresponding lock projections. The lock projections preferably have a relatively straight diverging upper surface and a rounded bottom surface. The rounded bottom surface has a radius that allows the projection bottom surface to be in locking contact with a corresponding portion of a cover groove. The fuse base has a spacing ridge on the bottom thereof that spaces the fuse bottom surface above a circuit board surface. The fuse also has a plurality of pressure relieving passageways extending from inside the fuse to the outside of the fuse. The pressure relieving passageways are generally formed by both the cover and the fuse base. In one embodiment the pressure relieving passageways have a longitudinally extending channel formed in the periphery of the fuse base. The channels extend from the top of the fuse base to the bottom of the fuse base and/or the bottom of the spacing ridge. The cover, when placed on the base defines the passageways. The cover is spaced above the circuit board so as to allow pressure to escape from inside the fuse to the outside of the fuse.

DETAILED DESCRIPTION OF THE PREFERRED EMBODIMENT OF THE INVENTION

Figure 1:
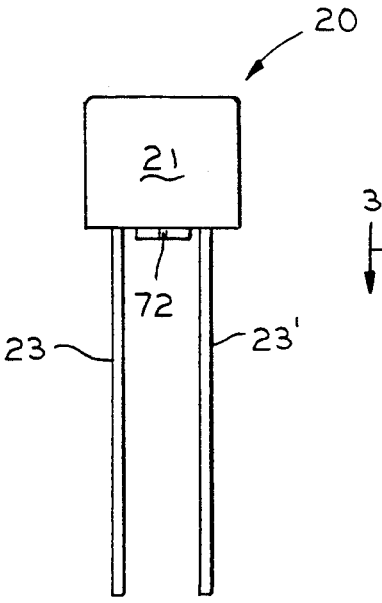
FIG. 1 is a side view of the subminiature fuse of the present invention.
Figure 2:
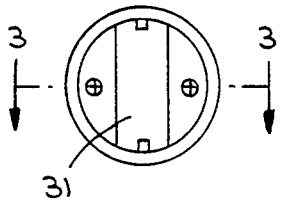
FIG. 2 is a bottom view of the subminiature fuse of FIG. 1.

Referring to FIGS. 1 and 2, our sub-miniature fuse 10 has a cap or cover 21. The cap 21 covers and is connected to a fuse base or body 22. The cap and base are cylindrical. A pair of parallel or substantially parallel electrodes 23, 23' are attached to the base and extend above and below the base. A fuse element 36 extends between the electrodes 23.23' and is to or adjacent to the upper ends 24, 24' of the electrodes. The upper ends 24, 24' of the electrodes are spaced from the top inner surface 25 of the cover 21. The fuse element is sized to blow open or rupture when a predetermined over-current passes therethrough. Each fuse is rated for a particular voltage and current and is set to rapidly open when a predetermined over-current and/or voltage is reached.

The portion of the electrodes 23, 23' above the base are spaced from the inner surfaces of the cover.

Each of the electrodes 23, 23' has a bulbous projection 27, 27' thereon. The bulbous projections 27 and 27' are spaced a predetermined distance from the top electrode 24, 24'. The bulbous projections are spaced such that they will be within the fuse base 22 when the fuse base is molded onto the electrodes in a known manner. The bulbous projections 27, 27' provide a means for anchoring the electrodes to the base 22. These bulbous projections aid in maintaining the orientation of the electrodes With regard to the base 22 prior to the fuse 20 being attached to a printed circuit board.

Figure 11:
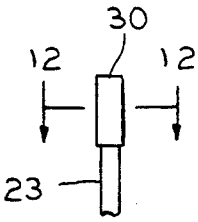
FIG. 11 is a partial side view of an electrode used in the present invention.
Figure 12:
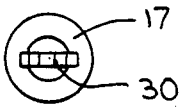
FIG. 12 is a cross sectional view taken along lines 12—12 of FIG. 11.
Figure 13:
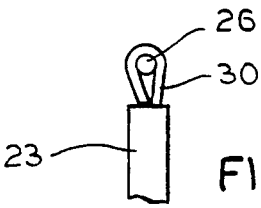
FIG. 13 is a partial side view of an electrode having a fuse element attached to the end thereof.

The electrodes 23, 23' are preferably cylindrical metal electrodes. However, it is understood that the shape and sizes of the electrodes is dependent upon the end use of the fuse. Preferably the fuse element 36 is welded or brazed to the electrode ends 24, 24'. One advantageous way of attaching the fuse element to the electrode ends 24, 24' is to first flatten the ends of the electrodes to provide flat end portions 30. FIGS. 11 and 12 show only one electrode 23 for illustrative purposes. It is understood that this also applies to electrode 23'. The flattened portion is bent or crimped over fuse element wire 26 as shown in FIG. 13. The fuse element wire 26 is then brazed or welded to the electrode 23.

The base 22 of the fuse 20 is a molded plastic. The plastic is an appropriately insulative type plastic generally used for fuses of s this type, i.e., a polyphenyl sulfide filled with glass. Referring to FIG. 3–7, the base has a top end surface 28 and a bottom end surface 29. The top end surface 28 is enclosed by the cover 21 and the bottom end surface 29 is exposed. Projecting from the bottom end surface 29 is a spacing ridge 31. The spacing ridge 3 diametrically extends across the bottom end of the base. The spacing ridge 31 as shown is substantially rectangular except for its ends which form an arc co-extending with the side surface of the cylindrical base 22.

Figure 4:
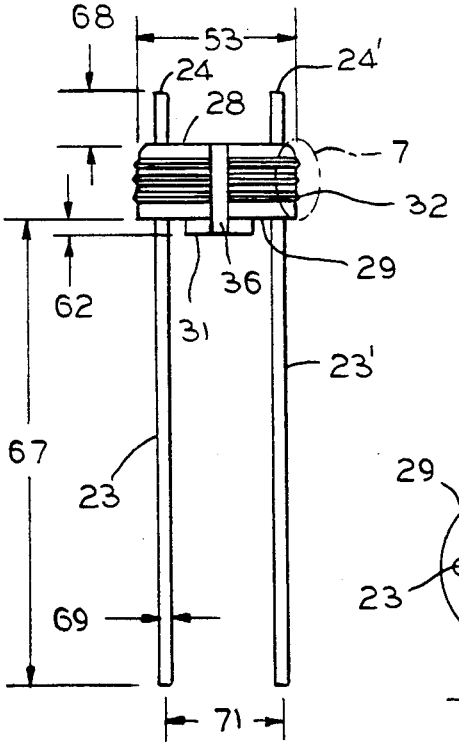
FIG. 4 is a side fuse of a base of the subminiature fuse of FIG. 1.
Figure 7:
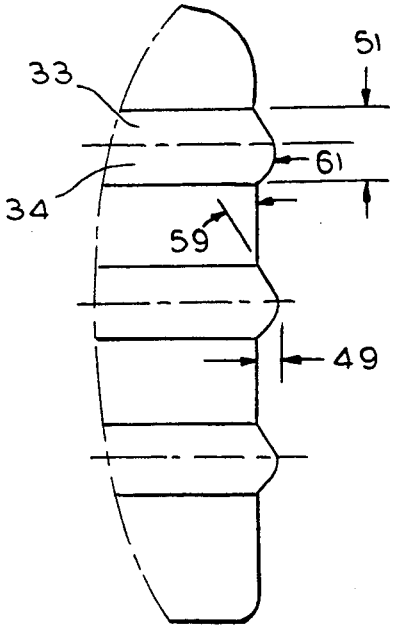
FIG. 7 is an enlarged view taken along line 7 of FIG. 4.

The spacing ridge 31 extends from the bottom end surface 29 a sufficient distance to provide a space between the fuse and the printed circuit board (not shown) on which the fuse is mounted. The base 22 has around its periphery a plurality of longitudinally spaced annular locking ridges or projections 32. The locking projections 32 have an upper frusto-conical surface 32 and a bottom rounded surface 34. The upper surface 33 diverges from the external side surface of the base to the bottom rounded surface at an angle of 30° to 55° to the side surface of the base. As shown in FIGS. 4 and 7, there are preferably three locking ridges 32 equally spaced from each other.

A plurality of vents are formed in the base. Shown are two vents 36 and 37 that extend from the top surface 28 to the bottom surface of the ridge 31. The vents 36 and 37 define with the inside cover wall open continuous passageways leading from the inside cover chamber 35 to outside the fuse.

Figure 5:
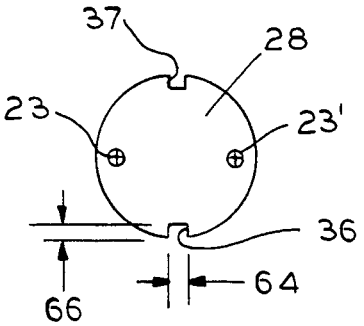
FIG. 5 is a top view of the base of FIG. 4.
Figure 6:
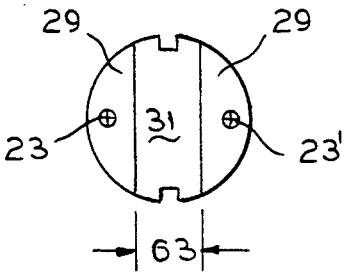
FIG. 6 is a bottom view of he base of FIG. 4.

The vents as shown in FIGS. 4 to 6 are channels formed approximately 180° apart in the periphery of the base. The channels 36 and 37 are straight and extend longitudinally from the top end surface 28 to the bottom of the spacing ridge 31. The channels are spaced approximately 90° from the electrodes 23, 23'.

Figure 14:
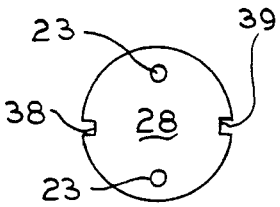
FIG. 14 is a top view of an alternative fuse base.
Figure 15:
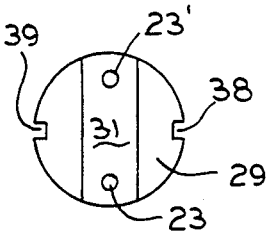
FIG. 15 is a bottom view of the base of FIG. 14.

An alternative embodiment as shown in FIGS. 14 and 15 would be to have the electrodes extend through the opposite ends of the spacing ridge and to have channels 38 and 39 extending from the top end surface 28 to the bottom end surface 29.

Figure 16:
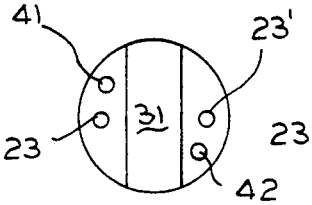
FIG. 16 is a bottom view of still another fuse base.

Still another alternative as shown in FIG. 16 has holes 41 and 42 extending from the top end surface 28 through the bottom end surface 29. The electrodes 23 and 23' may either be located as shown in FIG. 16 or located as shown in FIGS. 14 and 15. The holes 41 and 42 may be located as desired to exit the bottom wall 29.

Still another embodiment for the vent passageways is to make the passageways as non-straight passageways. By making the passageways non-straight, this reduces substantially the possibility of the interior of the fuse getting wet when the circuit board is washed. The general practice of assembling fuses on circuit boards is to attach the fuse onto the circuit board by soldering or other appropriate means. The circuit board, after being assembled, is washed.

Figure 18:
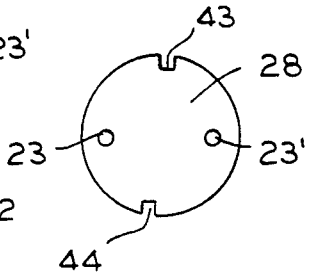
FIG. 18 is a top view of the base of FIG. 17.
Figure 17:
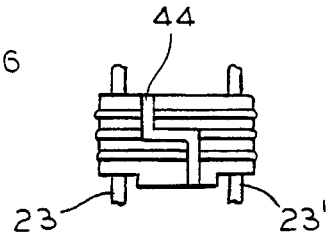
FIG. 17 is a side view of another fuse base.
Figure 19:
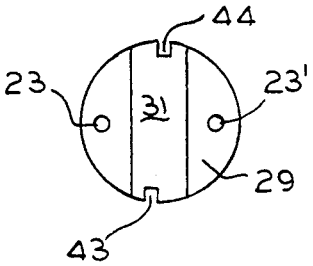
FIG. 19 is a bottom view of the base of FIG. 18.

FIGS. 17 to 19 illustrate the zig-zag passageways 43 and 44. The zig-zag passageways 43 and 44 as shown provide a first leg that extend longitudinally from the periphery of the top end surface 28 through the first annular lock projection 22. A second leg of the passageways extend at substantially right angles to and from the first leg along the periphery of the base through a portion of the second annular locking projection. A third leg of the passageways extend longitudinally from the second leg through the third annular locking projection through the periphery of the spacing ridge to the end surface of the spacing ridge.

Figure 8:
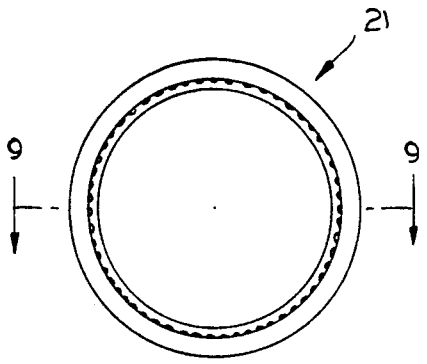
FIG. 8 is a top view of the cap of the subminiature fuse of FIG. 1.
Figure 9:
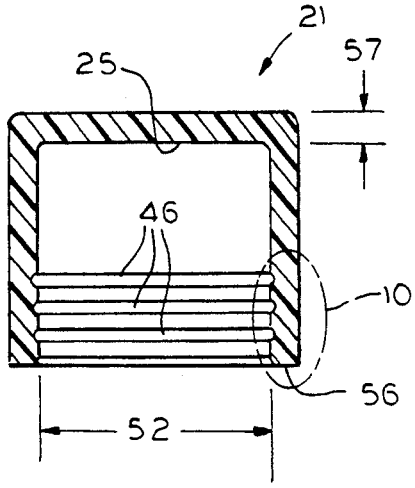
FIG. 9 is a cross sectional view taken along lines 9—9 of FIG. 8.
Figure 10:
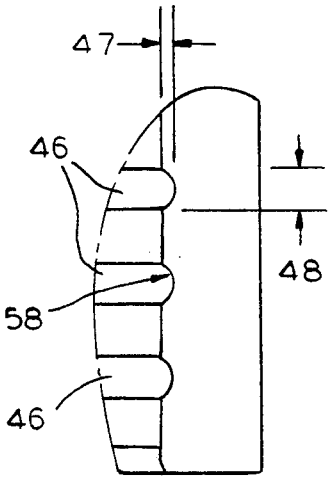
FIG. 10 is a cross sectional view taken along lines 9—9 of FIG. 9.

The cover 21 as shown in FIGS. 8 to 10 has a plurality of annular grooves 46. The grooves 46 have substantially the same radius as the radius of the bottom rounded surfaces 34 of the locking projection 32. The depth 47 and outer width 48 of the grooves 46 are substantially equal to the height 49 or distance the locking projection extend from the external surface of the base and the width 51 of the locking projections. The inner diameter 52 of the cover is substantially equal to the outer diameter 53 of the base.

The cover generally is sized preferably to have its end 56 stop at the base end surface 29 and to have its inner end surface 25 spaced a predetermined distance above the electrodes 23, 23' and the fuse element 26.

When the fuse is assembled onto a circuit board, the cover end 56 is spaced from the circuit board. The cover is generally made from an appropriate insulative plastic, i.e., polyaryl sulfone. A desirable plastic would be a clear plastic rather than a colored or black plastic. The clear plastic would permit visual inspection of the fuse to show whether or not the fuse had blown.

The size of the cover and fuse is generally dictated by the standards presently being used and the equipment being used to install the fuses on a circuit board. A fuse having the configuration of FIGS. 1–10 and being rated as 250 volts and 1/16 to 5 amp has the following dimensions.

The cover, FIGS. 9 and 10, has a top wall thickness 57 of about 0.81±0.5 mm. The grooves have a depth 47 of 0.10±0.03 mm, a width 48 of 0.36±0.03 mm and a radius 50 of 0.30±0.05 mm.

The base, FIGS. 4 to 7, has a diameter 53 of about 6.65±0.05. The annular lock projections 32 extend outwardly from the external surface of the base to provide a depth 49 of about 0.10±0.03 mm. The upper frustro-conical surface 33 extends at an angle 59 of about 30°. The lower rounded portion 34 has a radius 61 of about 0.30±0.03 mm. The space ridge 31 extends below the lower end surface 29 for a distance 62 of 0.51±0.05 mm. The width 63 of the space ridge is about 2.92±0.05 mm. The width 64 of the channels 36 and 37 are about 0.81±0.5 mm and the radial depth 66 of the channels are 0.21±0.05 mm.

The electrodes extend a distance 67 of about 19.30±0.05 mm below the bottom end surface 29 and a distance 68 above the upper end surface of about 2.03±0.05 mm. The electrodes have a diameter 69 of about 0.64±0.05 mm and their center lines are spaced apart a distance 71 of about 5.08±0.23 mm.

The frusto-conical portion of the lock projections allows the cover 21 to be easily pushed onto the base. The round portions of the locking projections grasp the cover grooves 36 and substantially lock the cover onto the base.

Figure 3:
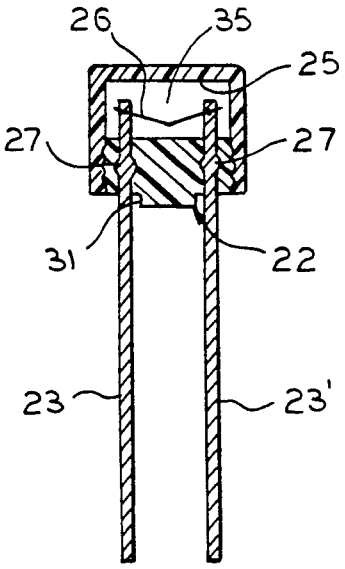
FIG. 3 is a cross-section view taken along lines 3—3 of FIG. 2.

When the cover 21 is locked onto the base, the cover end 56 substantially ends at the bottom end surface. As shown in FIG. 3, the cover inner surface extends above the electrodes to provide the fuse chamber 35. When the fuse blows, the pressure builds up in the chamber 35 and is vented through the passageways 36 and 37 and out the pressure opening 72 (FIG. 1).

As an alternative embodiment, the pressure opening 72 or any of the pressure openings formed by the embodiments of FIGS. 14 to 19 may be closed to prevent washing fluid from going into the opening and the respective passageways. A plug with a wider outer end may be used to close the opening or a closing flap or membrane may be used to close the opening. The plug would be blown out of the opening by the internal pressure in the passageways when the fuse blows. When the circuit board is being washed, the washing fluid pushes the outer diameter of the plug into the opening to close the opening and prevent washing fluid from entering the passageways. The closing flap or membrane is basically designed to be a flap that opens and closes the passageways in a similar manner as the plug.

Other variations and mechanical equivalents will become apparent to those skilled in the art when this specification is read in conjunction with the appended claims and drawings and the intent is for such claims to be read as broadly as permitted by existing art.

We claim:

1. A subminiature fuse comprising a base, a pair of electrodes extending above and below the base, a fuse element extending between the electrodes above said base, a cover attached to said base, said cover enclosing said fuse element and a top surface of said base, said cover inner surface being spaced from said fuse element and defining a fuse chamber with said base, and at least one vent passageway formed in the periphery of said base extending from said top surface of said base to an opening below said cover.

2. The fuse of claim 1 wherein said fuse base has at least one periphery lock projection and said cover has at least on corresponding lock groove capturing said lock projection.

3. The fuse of claim 2 wherein there are at least three lock projections with each lock projection having a straight diverging upper surface and a lower locking surface.

4. The fuse of claim 3 wherein the lower locking surface is curved.

5. The fuse of claim 1 wherein there are a plurality of passageways extending longitudinally along the periphery of said base from said top surface.

6. The fuse of claim 4 wherein there are a plurality of passageways extending longitudinally along the periphery of said base from said top surface.

7. The fuse of claim 1 wherein said fuse base has a space ridge projecting from the bottom surface of said base and there are a plurality of passageways extending longitudinally along the periphery of said base from said top surface.

8. The fuse of claim 3 wherein there are a plurality of vent passageways.

9. The fuse of claim 3 wherein there are a plurality of vent passageways and a plurality of vent openings opening below said cover.

10. The fuse of claim 9 wherein said passageways are internal passageways defined by said base.

11. The fuse of claim 9 wherein said passageways are passageways defined by said base and said cover.

12. The fuse of claim 11 wherein said passageways extend in more than one direction.

13. The fuse of claim 4 wherein said fuse base has a space ridge projecting from the bottom surface of said base, a plurality of said vent passageways extending longitudinally along the periphery of said base from said top surface and defined by said cover.

14. The fuse of claim 12 wherein the lower locking surface is curved and said fuse base has a space ridge projecting from the bottom surface of said base.

15. The fuse of claim 3 wherein said fuse element is attached to flattened folded-over ends of said electrodes.

* * * * *